US006085905A

United States Patent [19]

Miksic et al.

[11] Patent Number: 6,085,905

[45] Date of Patent: Jul. 11, 2000

[54] WATER-SOLUBLE CONTAINERS FOR WATER COOLING TOWERS AND BOILERS

[75] Inventors: Boris A. Miksic, North Oaks; Margarita Kharshan, Little Canada, both of Minn.

[73] Assignee: Cortec Corporation, St. Paul, Minn.

[21] Appl. No.: 09/400,931

[22] Filed: Sep. 22, 1999

[51] Int. Cl.[7] ..... B65D 71/00

[52] U.S. Cl. ..... 206/524.4; 206/524.7

[58] Field of Search ..... 206/0.5, 524.1, 206/524.4, 524.6, 524.7

[56] References Cited

U.S. PATENT DOCUMENTS 5,645,169 7/1997 Dull et al. ..... 206/524.7
5,733,616 3/1998 Janicki et al. ..... 206/524.7

*Primary Examiner*—Jacob K. Ackun
*Attorney, Agent, or Firm*—Haugen Law Firm PLLP

[57] ABSTRACT

A method of protecting water reservoirs or enclosures utilized in thermal energy conversion applications against corrosion during periods of shutdown by depositing a source of a vapor phase corrosion inhibitor, preferably a blend of ammonium benzoate, sodium benzoate, sodium sebacate, monoethanolammonium benzoate, benzotriazole, and cyclohexylammonium benzoate within the enclosure through the steps of packaging a vapor phase corrosion inhibitor in powder form within a container fabricated from a water-soluble film; perforating the walls of the container; depositing the perforated container within the enclosure being protected; and introducing water into the enclosure at the end of the shutdown period for simultaneously flushing the enclosure and removal of both the residual corrosion inhibitor and water-soluble container therefrom.

9 Claims, No Drawings

WATER-SOLUBLE CONTAINERS FOR WATER COOLING TOWERS AND BOILERS

BACKGROUND OF THE INVENTION

The present invention relates generally to an improved method and packaging arrangement for use in effective and convenient technique for protecting water reservoirs utilized in thermal energy conversion applications against corrosion during periods of shutdown. The method involves packaging vapor phase corrosion inhibiting chemicals (VCI) in water soluble containers or pouches, so as to permit the deposit of the package directly into the confines of the vessel or enclosure being protected, with removal being accomplished through conventional flushing of any residual VCI along with the water soluble pouch or container prior to placing the system back into service.

Thermal energy conversion applications such as boilers and water cooling towers are typically utilized on a seasonal basis. During periods of shutdown, it has been customary to protect the vessels or containers utilized as water reservoirs by flushing the system with biocides along with a film-forming oil or other composition to provide some measure of protection for the surfaces during periods of shutdown. This practice, while commonly employed, is environmentally unfriendly because of the nature of the solutions normally employed. Furthermore, this practice has some disadvantages in that some areas intended to be protected remain exposed to corrosive components during shutdown, thereby requiring extensive cleanup prior to returning the system to use. Another system commonly employed for interior protection of the vessel against corrosion is to fog dry chemicals of the VCI type into the enclosed space. However, this method requires special application equipment which is quite costly, and because of the expense involved, extensive use has been precluded.

SUMMARY OF THE INVENTION

The present system is straightforward and simple, and provides a labor-saving method of accomplishing effective corrosion protection during periods of shutdown, with the system further providing rapid cleanup and recovery when the unit is to be returned to operation.

In accordance with the present invention, vapor phase corrosion inhibitors (VCI's) are packaged in a water-soluble pouch or bag, with the bag being initially perforated prior to use, and then deposited in its entirety into the enclosure to be protected. The VCI's are continuously emitted from the pouch or container through holes or cuts formed in the enclosed space, thus providing long-term protection for the vessel or unit from corrosion. The size of the pouch or other container that is utilized depends, of course, upon the magnitude of the volume being protected. Generally, three pounds of VCI powder, as described hereinbelow, are suitable for protecting a 1,000 gallon boiler for a period of up to six months.

Because the nature of use of water cooling towers and boilers is seasonal, there comes a time following shutdown when the unit is to be returned to service. The removal of the residual VCI's is extraordinarily simple, merely requiring flushing so as to dissolve the water-soluble bag or pouch along with the remaining VCI's out of the system.

Therefore, it is a primary object of the present invention to provide an improved technique for protecting water reservoirs utilized in thermal energy conversion applications against corrosion during periods of shutdown by utilizing a source of VCI within a pouch or enclosure fabricated from a water-soluble film.

It is a further object of the present invention to package a selected VCI material within a water-soluble bag, and thereafter preserving the water-soluble bag and its contents in a waterproof container until just prior to use, at which time the water-soluble bag is perforated and deposited into the interior of a water reservoir utilized in thermal energy conversions such as a water cooling tower or boiler.

Other and further objects of the present invention will become apparent to those skilled in the art upon a study of the following specification and appended claims.

DESCRIPTION OF THE PREFERRED EMBODIMENT

In order to effectively practice the present invention, a powder mix of VCI chemical is selected for long-term use within a thermal energy conversion system, such as a boiler system. In order to describe the features of the invention, the following general example is provided.

GENERAL EXAMPLE

A selected powder mix of VCI chemicals is produced from the chemicals such as the following:

| Component | Range of Parts by Weight of Formulation |
|---|---|
| Ammonium benzoate | 85–95 parts |
| Sodium benzoate | 2.5–7.5 parts |
| Cyclohexylammonium benzoate | 2.5–7.5 parts |
| Monoethanolammonium benzoate | 2.5–7.5 parts |
| Sodium sebacate | 2.5–7.5 parts |
| Benzotriazole | 2–5 parts. |

With this range of components, suitable long-term protection is provided for the interior of the vessel being protected.

EXAMPLE I

A powder mix especially suitable for a boiler is prepared from the following chemicals:

| Component | Parts by Weight of Formulation |
|---|---|
| Ammonium benzoate | 83 parts |
| Monoethanolammonium benzoate | 5 parts |
| Benzotriazole | 2 parts |
| Cyclohexylammonium benzoate | 10 parts. |

EXAMPLE II

A powder mix especially suitable for a cooling tower is prepared from the following chemicals:

| Component | Parts by Weight of Formulation |
|---|---|
| Ammonium benzoate | 20 parts |
| Sodium benzoate | 10 parts |
| Sodium sebacate | 40 parts |

-continued

| Component | Parts by Weight of Formulation |
|---|---|
| Monoethanolammonium benzoate | 10 parts |
| Benzotriazole | 5 parts |
| Cyclohexylammonium benzoate | 15 parts. |

The working formulation or mix was packaged in a water-soluble bag. Water-soluble bags are available commercially, with one such product being offered from Aqua-Film of Winston Salem, N.C. under the trade designation "Series L". This pouch or bag is soluble in cold water, and hence selected for this application. After filling of the pouch or bag, the unit is placed within a waterproof container and retained until its need is indicated. Thereafter, the bag or pouch is removed from the waterproof container and holes are cut or slit in the bag and it is then merely dropped into, or otherwise deposited into the confines of the boiler. This may be undertaken through a convenient inspection port or opening typically found in boiler assemblies. The vapor phase corrosion inhibitor chemicals emit from the bag and effectively protect the surfaces of the enclosed space. When it is necessary to return the unit to service, the bag or pouch and its remaining contents are conveniently flushed from the boiler with plain water. For adequate protection, boilers typically require about three pounds of powder per 1,000-gallon boiler capacity.

It will be appreciated that the features of the present invention as illustrated herein are for purposes of describing the invention, and are not to be construed as a limitation upon the scope to which the present invention is entitled.

What is claimed is:

1. Means for protecting the surfaces of water reservoirs utilized in thermal energy conversion applications against corrosion during periods of shutdown, said protecting means comprising:

(a) a waterproof outer container;

(b) a water-soluble pouch within said outer container; and (c) a vapor phase corrosion inhibitor in powder form packaged within said pouch.

2. The means for protecting water reservoirs as defined in claim 1 being particularly characterized in that said vapor phase corrosion inhibitor has the following formulation range:

| Component | Parts by Weight of Formulation |
|---|---|
| Ammonium benzoate | 83 parts |
| Monoethanolammonium benzoate | 5 parts |
| Benzotriazole | 2 parts |
| Cyclohexylammonium benzoate | 10 parts. |

3. The means for protecting water reservoirs as defined in claim 1 being particularly characterized in that said vapor phase corrosion inhibitor comprises the following formulation:

| Component | Parts by Weight of Formulation |
|---|---|
| Ammonium benzoate | 20 parts |
| Sodium benzoate | 10 parts |
| Sodium sebacate | 40 parts |
| Monoethanolammonium benzoate | 10 parts |
| Benzotriazole | 5 parts |
| Cyclohexylammonium benzoate | 15 parts. |

4. The method of protecting water reservoirs or enclosures utilized in thermal energy conversion applications against corrosion during periods of shutdown by depositing a source of a vapor phase corrosion inhibitor within the enclosure through the following steps:

(a) packaging a vapor phase corrosion inhibitor in powder form within a container fabricated from a water-soluble film;

(b) perforating the walls of said container;

(c) depositing said perforated container within the enclosure being protected; and (d) introducing water into the enclosure at the end of the shutdown period for simultaneously flushing said enclosure and removal of both the residual corrosion inhibitor and water-soluble container therefrom.

5. The method as defined in claim 4 being particularly characterized in that said vapor phase corrosion inhibitor comprises the following formulation:

| Component | Parts by Weight of Formulation |
|---|---|
| Ammonium benzoate | 83 parts |
| Monoethanolammonium benzoate | 5 parts |
| Benzotriazole | 2 parts |
| Cyclohexylammonium benzoate | 10 parts. |

6. The method of claim 4 being particularly characterized in that said vapor phase corrosion inhibitor comprises the following formulation:

| Component | Parts by Weight of Formulation |
|---|---|
| Ammonium benzoate | 20 parts |
| Sodium benzoate | 10 parts |
| Sodium sebacate | 40 parts |
| Monoethanolammonium benzoate | 10 parts |
| Benzotriazole | 5 parts |
| Cyclohexylammonium benzoate | 15 parts. |

7. The method of claim 4 wherein said vapor phase corrosion inhibitor is introduced into said enclosure in the range of four pounds of vapor phase corrosion inhibitor per 1,000-gallon capacity of said reservoir or enclosure.

8. The method of claim 4 wherein said thermal energy conversion application is a boiler or other closed loop system.

9. The method of claim 4 wherein said thermal energy conversion application is a water cooling tower.

* * * * *

UNITED STATES PATENT AND TRADEMARK OFFICE
CERTIFICATE OF CORRECTION

PATENT NO : 6,085,905
DATED : July 11, 2000
INVENTOR(S) : Boris A. Miksic, et al.

It is certified that error appears in the above-identified patent and that said Letters Patent are hereby corrected as shown below:

Item (75) Inventors: Boris A. Miksic, North Oaks;
Margarita Kharshan, Little Canada,
both of Minn.

should read:

Boris A. Miksic, North Oaks;
Margarita Kharshan, Little Canada; and
Allan J. Bly, Mound
all of Minn.

Signed and Sealed this

Tenth Day of April, 2001

Nicholas P. Godici

*Attest:*

NICHOLAS P. GODICI

*Attesting Officer*

*Acting Director of the United States Patent and Trademark Office*